US009702626B2

(12) United States Patent
He et al.

(10) Patent No.: US 9,702,626 B2
(45) **Date of Patent: *Jul. 11, 2017**

(54) DEVICE AND METHODS FOR RAPID DRYING OF POROUS MATERIALS

(71) Applicant: InstroTek, Inc., Raleigh, NC (US)

(72) Inventors: Tianqing He, Cary, NC (US); Ali Regimand, Raleigh, NC (US); Lawrence H. James, Raleigh, NC (US); Peter D. Muse, Durham, NC (US)

(73) Assignee: InstroTek, Inc., Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/472,919

(22) Filed: Aug. 29, 2014

(65) Prior Publication Data

US 2014/0366560 A1 Dec. 18, 2014

Related U.S. Application Data

(60) Continuation of application No. 13/533,153, filed on Jun. 26, 2012, now Pat. No. 8,826,564, which is a (Continued)

(51) Int. Cl.

| | |
|---|---|
| ***F26B 21/10*** | (2006.01) |
| ***F26B 21/00*** | (2006.01) |
| ***F26B 5/04*** | (2006.01) |
| ***F26B 9/00*** | (2006.01) |
| ***F26B 25/22*** | (2006.01) |

(Continued)

(52) U.S. Cl.

CPC ..... *F26B 21/10* (2013.01); *F25B 21/02* (2013.01); *F26B 5/048* (2013.01); *F26B 9/003* (2013.01); *F26B 21/00* (2013.01); *F26B 25/14* (2013.01); *F26B 25/225* (2013.01); *F25B 2321/02* (2013.01)

(58) Field of Classification Search

CPC ..... F26B 21/00; F26B 21/10; F26B 25/14; F26B 25/225; F26B 5/048; F26B 9/003; F25B 21/02; F25B 2321/02

See application file for complete search history.

(56) References Cited

U.S. PATENT DOCUMENTS

| | | | |
|---|---|---|---|
| 560,561 | A | 5/1896 | Zappert |
| 763,388 | A | 6/1904 | Gathmann |

(Continued)

FOREIGN PATENT DOCUMENTS

| | | |
|---|---|---|
| JP | 09090090 A | 4/1997 |
| WO | WO 00/29122 | 5/2000 |

*Primary Examiner* — Jiping Lu

(74) *Attorney, Agent, or Firm* — Myers Bigel, P.A.

(57) ABSTRACT

An apparatus and method for quickly drying porous materials. A sealable chamber is connected to a cold trap which is connected to a vacuum pump. A sample is placed inside the sealable chamber. The vacuum pump is turned on and air is evacuated through the cold trap to the vacuum pump. An infrared lamp may be used to heat the chamber and sample therein directly or heated air may be allowed to enter the sealable chamber. Air may be drawn directly from the sealable chamber to the vacuum pump bypassing the cold trap. Various parameters may be used to determine if the drying process is complete, including the degree of vacuum achieved in the chamber.

19 Claims, 4 Drawing Sheets

Related U.S. Application Data division of application No. 12/822,638, filed on Jun. 24, 2010, now Pat. No. 8,225,526, which is a continuation of application No. 10/714,471, filed on Nov. 15, 2003, now abandoned.

(51) Int. Cl.
*F25B 21/02* (2006.01)
*F26B 25/14* (2006.01)

(56) References Cited

U.S. PATENT DOCUMENTS 3,521,373 A 7/1970 Pagnozzi ..... 34/406
3,643,340 A 2/1972 Jackson et al.
4,107,049 A 8/1978 Sano et al.
4,319,408 A 3/1982 Kuboyama
4,686,852 A 8/1987 Ito et al.
4,882,851 A 11/1989 Wennerstrum et al.
5,377,425 A 1/1995 Kawakami et al.
5,546,678 A 8/1996 Dhaemers
5,732,478 A 3/1998 Chapman et al.
5,755,039 A 5/1998 Mae et al.
5,802,086 A * 9/1998 Hargis ..... H01S 3/108 372/22
5,806,204 A * 9/1998 Hoffman ..... D06F 58/12 34/605
6,084,745 A * 7/2000 Slezak ..... G11B 33/1453 360/97.22
6,085,443 A 7/2000 Hunter et al.
6,087,419 A 7/2000 Fields ..... 524/62
6,234,008 B1 5/2001 Sjoblom et al.
6,321,589 B1 11/2001 Regimand
6,410,889 B2 6/2002 Davis et al.
7,096,600 B2 8/2006 Singh
8,826,564 B2 * 9/2014 He ..... F26B 5/048 34/530
2003/0079368 A1 * 5/2003 Hoffman ..... D06F 58/24 34/202
2004/0099332 A1 * 5/2004 Kieck ..... A47J 47/12 141/65
2009/0272279 A1 * 11/2009 Kieck ..... A47J 47/12 99/468

* cited by examiner

DEVICE AND METHODS FOR RAPID DRYING OF POROUS MATERIALS

RELATED APPLICATIONS

This is a continuation application of U.S. patent application Ser. No. 13/533,153, filed Jun. 26, 2012, which is a divisional application of U.S. patent application Ser. No. 12/822,638, filed Jun. 24, 2010, now U.S. Pat. No. 8,225,526, which is a continuation application of U.S. patent application Ser. No. 10/714,471, filed Nov. 15, 2003, the disclosures of which are incorporated herein in their entireties.

FIELD OF THE INVENTION

This invention relates generally to methods and apparatus for the rapid drying of materials. More specifically, it is for the rapid drying of porous materials which must be dried for a determination of dry weight or mass. Dry weight is an important parameter in many industries, including the construction industry, where a specified dry weight maybe a requirement for evaluation of material quality.

BACKGROUND OF THE INVENTION

The dry weight of the material may be important in determining the density and moisture content of the material. There are many industries where the density and moisture content of material is an important value. In the asphalt industry, samples of asphalt are cut from a newly paved roadway or area where asphalt has been applied. To obtain the density of these materials, a dry weight must be determined. However, water is often introduced into the asphalt sample during the paving process itself. Also, to cut a sample from an asphalt pavement or for preparing samples of a certain size or shape, wet saws or augers are sometimes used. These introduce extra water into the sample, saturating the sample. Because of the natural water that may be present in the sample and because of water that may be introduced in the sample during the paving process or during the cutting process, it is necessary to dry samples to determine a dry weight, hence to calculate accurate density. Under the current practice, samples are placed in an oven heated to a temperature of 105° to 115° centigrade for a predetermined period of time, usually 16 to 24 hours. The water contained within the sample will be evaporated from the sample by the elevated temperature during this period of time. This will give a dried sample which then may be weighed to determine the dry weight. However, in some applications, the drying time required for this method is a drawback. It does not give an opportunity to take quick corrective action during a construction project, should it be determined that the density of the sample is outside of the parameters assigned the project and sample may be damaged by heat applied during drying period.

In the construction industry, compacted asphalt samples are tested using the ASTM Test D2726, the ASTM Test D6752, and the AASHTO Test T166. These tests require the determination of the density of the materials. This requires that the dry mass of a sample along with a sample volume be determined in order to calculate the density, which is the ratio of the mass to the volume. Moisture may be introduced into the sample by the cutting process or may be naturally present in the sample. Consequently, moisture is eliminated from the sample using the oven method described above or by placing the samples in front of a fan. Both methods require a period of time amounting to hours or, in the fan method, days for completely drying samples. Oven drying at higher temperatures could provide a quicker evaporation of the water from the sample, but ordinarily is not recommended. High temperatures can potentially change the characteristics of the sample and damage the sample for other tests that may be required.

In loose asphalt mixtures, it is important to determine the amount of moisture in the mixture. Excessive water can result in stripping of the asphalt binder film from the aggregate. Stripping can cause premature failure and pot hole creation in asphalt pavements. Currently, samples are taken at a site, placed in a sealed jar or container, weighed before drying, an oven-drying method is used to dry the sample, and then a second weight is taken. This will determine the amount of moisture in the sample. This method is not very practical and could be inaccurate because the sample can gain moisture from the atmosphere during the processing of the sample and during weighing of the sample.

Drying is also important in a variety of other industrial contexts. The moisture content of aggregates themselves oftentimes is measured as part of evaluation. The moisture content in raw material used in paper making process, including wood chips, pulp, and finished paper can be important during the manufacturing process. In the chemical industry, various powders and gels are dried during research and production testing. However, powders and gels cannot be exposed to high temperatures without a risk that the chemical composition of the powder or gel would be altered by the higher temperatures. Consequently, vacuum ovens are frequently used to dry gels or powders, but the drying process is a slow one and can take a long time.

Electronic components used in the electronic industry, including the computer industry, must be dried after washing with a solvent. Mae et al., U.S. Pat. No. 5,755,039 proposes a component dryer. A sealed chamber is used where components that are wet with solvent are placed in a vat with a bottom surface permeable to the solvent. Heated air is drawn into the chamber through an air inlet. A fan or other means is placed at the bottom of the chamber to pull air through an air outlet. The heated air is brought into the chamber by the draw created by the fan, passes through the components, and is pulled into the air outlet for exhaust from the chamber by the fan. The air allowed into the chamber is less than the volume of air removed from the chamber by the fan, hence a negative pressure is created in the chamber below the vat containing the components.

Ito et al., U.S. Pat. No. 4,686,852 discloses a mechanical method for preparing mortar or concrete. Here, a fine aggregate is placed in an enclosed container, a centrifugal force is applied to the container of a predetermined period, the centrifugal force removes a portion of the water deposited on the fine aggregate, which allows appropriate determinations to be made. Kuboyama, U.S. Pat. No. 4,319,408 discloses a general drying apparatus. A partially sealed chamber is evacuated forcibly by a rotary means installed in the chamber. The air pressure within the chamber is reduced. A certain amount of air is allowed to be introduced into the chamber while maintaining a balanced pressure within the chamber. Air friction heat is generated by continuous rotation of the rotary air evacuator causing an increased air temperature within the chamber.

Chapman et al., U.S. Pat. No. 5,732,478 supplies heated fresh air to a chamber then evacuating the chamber to remove residual moisture. The flow of air is interrupted to the chamber during evacuation. Air knives are used to introduce the warm dry air into the chamber, which also insures entrained ambient air and a turbulent flow around the devices within the chamber which are to be dried. The Chapman device recognizes that interrupting the flow of heated air during evacuation of the chamber vaporizes moisture but cools the device, resulting in a risk of freezing.

Despite this earlier work there is still need for an improved rapid drying method and apparatus for use in industrial applications. It is an object of the invention to reduce the drying time required for samples. It is an object of the invention to do so in a controlled vacuum. It is an object of the invention to do so at a controlled temperature. It is an object of this invention to do so by controlling the time for vacuum and time for temperature applications. This maintains the material integrity of the samples while, at the same time, expediting the drying process. It is an object of the invention to provide a trap for liquids removed from the sample during the drying process.

SUMMARY OF THE INVENTION

The current invention consists of multiple components. First, is a sealable chamber that is vacuum tight. It may have at least one air inlet and at least one air outlet. Appropriate valves to open and close are attached to the air inlet and to the air outlet. Second, there is a heater, which can be controlled to heat air entering the chamber or to heat the interior of the chamber to a preset temperature. A heat pad may be placed on the bottom of the sample chamber to help in eliminating water particles that could fall on the bottom surface of the chamber during the drying process of the sample or to heat the chamber. This heat pad operates at a controlled temperature and may stay on at all times during the operation of the unit. On the air outlet line, there is a cold trap, which is designed to trap liquid or vapor exiting the chamber on the outlet air line. Ordinarily, this liquid would be water. Next there is a vacuum pump connected to the outlet line, which will pull air from the chamber. Air may be pulled directly through the vacuum pump or through the cold trap before being pulled through the vacuum pump. Finally, there are associated controls, usually electronic, to monitor and control the pump, the valves, any heaters, and function of the invention and to provide an interface with a user to allow a user to monitor and control operation of the invention. A sample is ordinarily placed inside the chamber. The inlet valve is closed. The outlet valve is opened. The vacuum pump is turned on, withdrawing air from the chamber and creating a vacuum within the chamber. The air that is withdrawn from the chamber is passed through the cold trap before being drawn through the vacuum pump. The cold trap effectively removes moisture or vapor from the air that is being withdrawn from the chamber. This prevents moisture or vapor from entering the vacuum pump, which can damage the pump and hurt pump performance. The cold trap uses a thermoelectric cooler to chill a metal container. Air flow is directed through the cold trap in a way to obtain maximum contact of air with cold surfaces. Vapor in the air removed from the sample chamber condenses on the cold surfaces and collects at the bottom of the chilled container cold trap. The cold trap also helps in reducing the pressure in the sample chamber by providing a natural air flow path from the chamber because of condensation of vapor in the cold trap reducing pressure in the cold trap. The air from the chamber will naturally flow to cold trap container causing a drop in pressure inside the sample chamber. The vacuum pump is operated for a predetermined amount of time reducing the pressure inside the chamber and causing evaporation of water from the sample and from the chamber. The vacuum pump can reduce the pressure inside the chamber to a particular and controllable vacuum setting. Due to the evaporation and low pressure, the temperature inside the sample chamber would be reduced significantly if not heated in some way. In one embodiment, the air may be heated to a preset temperature and allowed to enter the sealed sample chamber or, in another embodiment, the sample and the inside of the chamber may be heated directly. The vacuum pump continues to operate, which pulls the heated air from the chamber. However, if air entering the chamber is heated, then this heated air may be directed around the cold trap, so as not to affect the temperature within the cold trap. If so, this heated air bypasses the cold trap to go directly to the vacuum pump. The valve controlling the entry of heated air into chamber and the vacuum pump operation can be coordinated in a way that the vacuum level inside the sample chamber is at a controlled predetermined value. This means the vacuum within the chamber stays at a desirable level, which allows the moisture to continue to evaporate even during the heating cycle, thus further expediting the drying process. Without the introduction of heat, evacuation of air from the chamber, with the resulting vaporization of moisture on the sample, will lower the temperature of the sample, which slows the drying process. The heated air continues to pass through the sample chamber for a predetermined time keeping the sample at a predetermined desirable temperature and continuing the drying process. The heated air also passes through the vacuum pump and can dry any residual moisture that many have collected on the vacuum pump or its components. The chamber may be designed in such a way as to maximize the flow of heated air through the chamber so as to evenly distribute heated air around the sample within the chamber before the heated air is drawn through the air outlet by the operating vacuum pump. Keeping the temperature within the chamber at a predetermined desirable level avoids the slower drying caused by evaporation reducing the temperature in the sample, creating lower vapor pressure. Thus, the introduced heat shortens the drying time.

After a predetermined period of time, the warm air flow through the chamber is turned off. The inlet valve is closed. The air outlet line is again directed to pass through the cold trap, and the vacuum pump operates again pulling air from the now sealed chamber with air passing through the cold trap before passing through the vacuum pump. These processes will continue until there is a determination made that there has been a complete loss of moisture in the sample. This can be measured in a variety of ways, including the degree of vacuum obtained within the sample chamber or a change of weight in the sample itself. For example, if the pressure inside the chamber drops below approximately 10 TORR (10 mm HgA), which is known to be the pressure when the chamber is completely dry, then there is no moisture in the system. Alternatively, in another embodiment the sample can be sequentially or continuously weighed and as long as the process is causing a loss of weight within the sample, then it can be assumed that the moisture is being evacuated from the sample. However, if over a period of time, the sample weight remains constant (i.e., three consecutive weights within + or −0.05 grams) then it may be determined that all moisture has been effectively evacuated from the sample. In another embodiment, a transparent window may be provided to allow an infrared heating lamp to be installed and to continuously, in a controlled way, directly heat the sample eliminating the need for an air inlet and only having an outlet to the vacuum pump and cold trap. With the pump running continuously, this allows the pressure inside the chamber to remain very low and keep the sample temperature to a desirable level significantly speeding the drying process. The use of an infrared heat allows for more precise control of the heat inside the chamber. In this fashion, the chamber may be kept at a desirable temperature, like room temperature, without the concern that heat will build up in the chamber and degrade the sample. A potential drawback to heating air that is allowed to enter the chamber is that the amount of heat applied to the air can be difficult to control depending on the flow of the air through the heater into the chamber. Without careful control, there is a risk that the air temperature could rise too high affecting the sample or perhaps damaging components used in the drying process.

DETAILED DESCRIPTION OF THE DRAWINGS

Figure 1:
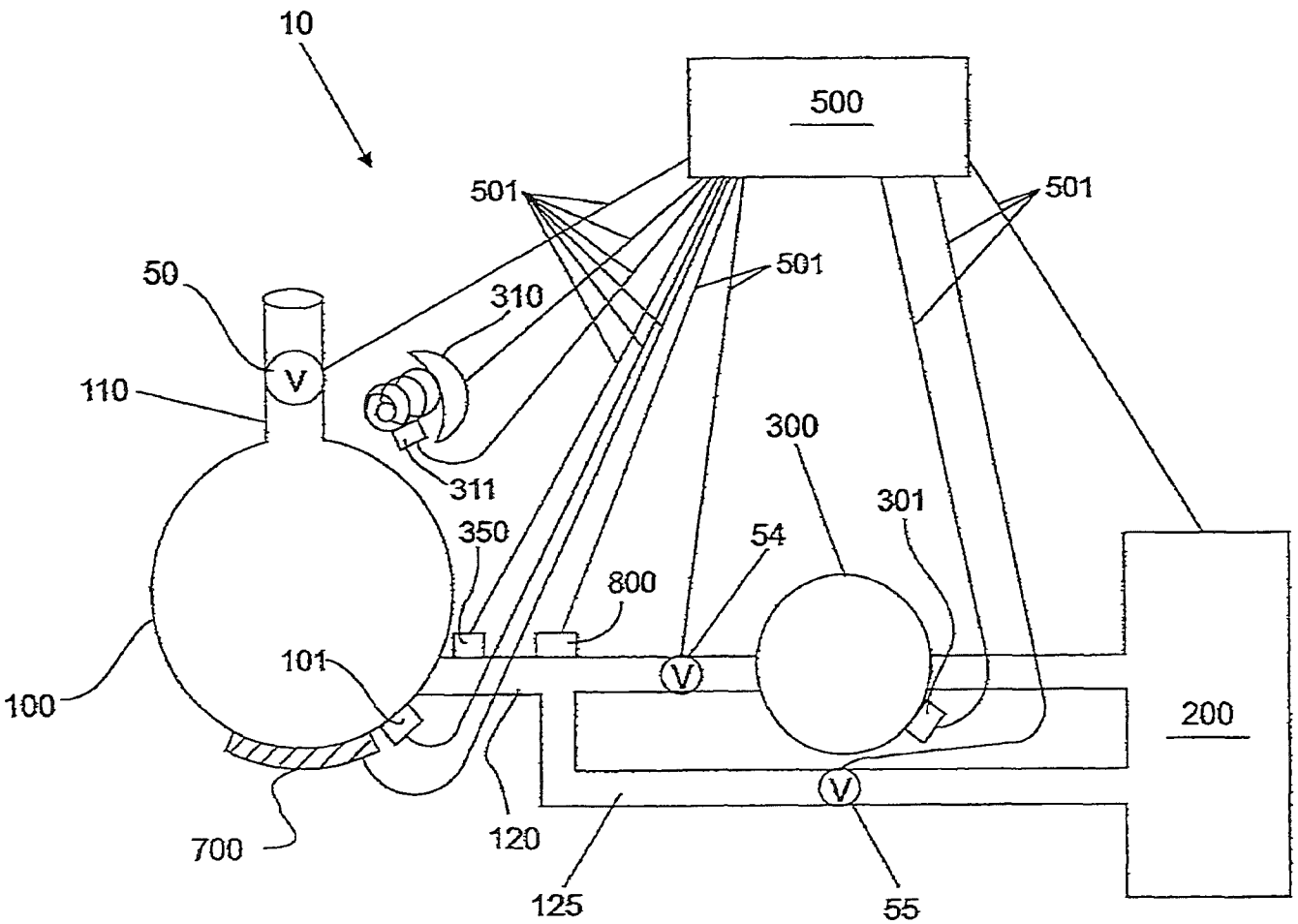
FIG. 1 shows in a rough block form components of the rapid drying invention.

FIG. 1 shows in a rough block form components of the rapid drying invention (10) These components may vary to some degree, depending on the embodiment chosen. However, all embodiments will have a sample chamber (100) which may be opened and closed. When closed it will be airtight except for specified inlets and outlets. All embodiments will have an air outlet (120), which is connected to a vacuum pump (200) through a cold trap (300). In one embodiment the outlet (120) may bypass the cold trap (300) through a bypass line (125). The vacuum pump (200) will operate to pull air from the closed sample chamber (100) through the outlet (120) either to the cold trap (300) then to the vacuum pump (200), or directly to the vacuum pump (200). When the sample chamber (100) is sealed with no air entering the chamber, the vacuum achieved in the sample chamber (100) by operation of the vacuum pump (200) will be at its highest level. The sample chamber (100) and the air inside the sample chamber (100) may be heated by a heater (310). Depending on the embodiments, the heater (310) may be positioned in different places. There is an air inlet (110) which may be opened to the outside air or closed to the outside air by a valve (50). Attached to the sample chamber (100) is a heat pad (700), which would ordinarily be positioned below a sample which might be placed inside the sample chamber (100). The purpose of the heat pad (700) is to facilitate drying of water droplets which may fall on the inside of the sample chamber (100) from a sample. When air is drawn from the sample chamber (100) through the outlet line (120) and through a cold trap (300) to the vacuum pump (200), the air leaving the sample chamber (100) passes through the cold trap (300) before entering the vacuum pump (200). The purpose of the cold trap (200) is to remove moisture from the air exiting the sample chamber (100) before entering the vacuum pump (200). The operation of the valves (50, 54, and 55), the vacuum pump (200), the heater (310), and the heat pad (700) are all controlled by the controller unit (500), which could be mechanical and/or electronic. The controller unit (500) will monitor the temperature of the heater (310) using temperature sensor (311), the chamber (100) using temperature sensor (101), and the cold trap (300) using temperature sensor (301). The controller (500) may use a vacuum gauge (800) to monitor and control the vacuum in the chamber (100). The controller may use a moisture gauge (350) to monitor moisture in air leaving the sample chamber (100). The controller (500) uses wires (501) to connect the controller (500) to the various parts of the rapid drying invention (10) to control and monitor its operation. It is believed, in a preferred embodiment, an electronic controller using appropriate central processing units and instrumentation will operate most effectively. This can provide feedback to an operator, including such things as the measure of vacuum achieved in the sample chamber (100), monitoring of the temperature within the chamber (100), monitoring the weight of a sample using a load cell (shown in later figures), as well as other desirable instrumentation.

In one mode of operation of the rapid drying invention (10), the valve (50) may be opened on the inlet line (110) to allow a controlled amount of air heated by the heater (310) to enter the sample chamber (100) and then to exit the sample chamber (100) through the outlet (120). In this mode, the valve (54) will be closed and the valve (55) will be opened, which means the heated air in the sample chamber (100) will be pulled to the vacuum pump (200) through the bypass line (125), bypassing the cold trap (300). In this embodiment, the vacuum pump (200) will be operated at a sufficient level to pull more air from the sample chamber (100) than is entering the sample chamber (100), at least until a vacuum at a desirable level is achieved in the sample chamber (100). Ordinarily, the vacuum achieved when air is entering the sample chamber (100) through the inlet line (110) through a partially opened valve (50) will be lower (hence, the pressure inside the chamber is higher) than would be the case when the sample chamber (100) is completely sealed and air is being drawn through the cold trap (300). Heated air drawn into the vacuum pump (200) will help dry the vacuum pump (200) and its components and increase the efficiency of the vacuum pump (200) and reduce the possibility of damage from moisture. The cold trap (300) as mentioned above removes moisture from air exiting the sample chamber (100), but also increases the efficiency of the vacuum pump (200) by creating a natural pressure gradient as water vapor condenses in the cold trap (300), thus reducing the air pressure in the cold trap (300).

Figure 2:
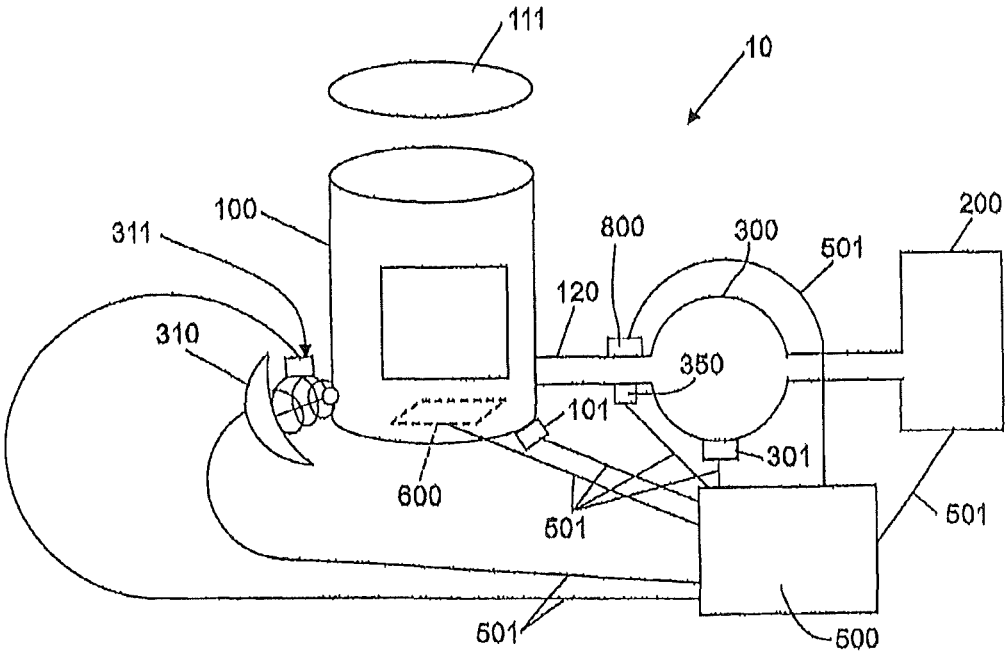
FIG. 2 is a simplified block figure showing an embodiment of the rapid drying invention

FIG. 2 is a simplified block figure showing an embodiment of the rapid drying invention (10). Here, an infrared heater (310) is used to directly heat the sample that may be placed inside the sample chamber (100) by removing the sample chamber lid (111) and placing the sample (not shown) on the load cell (600). The infrared heater (310) is operated in a controlled manner at the same time as the vacuum pump (200) is operating, hence the sample and air within the sample chamber (100) is heated by the infrared heater (310) and the heated air is pulled through the cold trap (300). The use of an infrared heat allows the sample to be heated directly, which is more efficient than drawing heated air through the chamber (100). The infrared heater (310) may be pulsed on and off as is required to keep the chamber (100) and the sample at a desirable temperature as monitored by the temperature sensors (311) and (101). Ordinarily, a desirable temperature would be around room temperature or perhaps slightly elevated. It is undesirable that the temperature become too low in the chamber since that slows the drying process. It is also undesirable to have the sample heated to an extreme elevated temperature since that affects the sample characteristics and can affect other tests other than determination of dry weight or mass. In this embodiment, there is only one cycle. The vacuum in the sample chamber (100) is maintained at the highest level and air leaving the sample chamber (100) through the outlet (120) passes directly through the cold trap (300) throughout the entire process to the vacuum pump (200). When a predetermined measurement of a parameter used to measure moisture in the sample is achieved, the cycle is deemed complete. The parameter used can be a weight determined by the load cell (600), or by repeatedly weighing the sample removed from the chamber (100), or a preset level of vacuum in the chamber (100) or by a humidity sensor (350) in the outlet line (120). The lid (111) will be equipped with a release valve (not shown) so that air may be allowed to enter the chamber to facilitate opening the lid (111) and removing the sample from the sample chamber (100). A heat pad (700) (shown in FIG. 1) could also be employed to facilitate evaporation of water drops that may fall off the sample when the sample is placed in the sample chamber (100).

Figure 3:
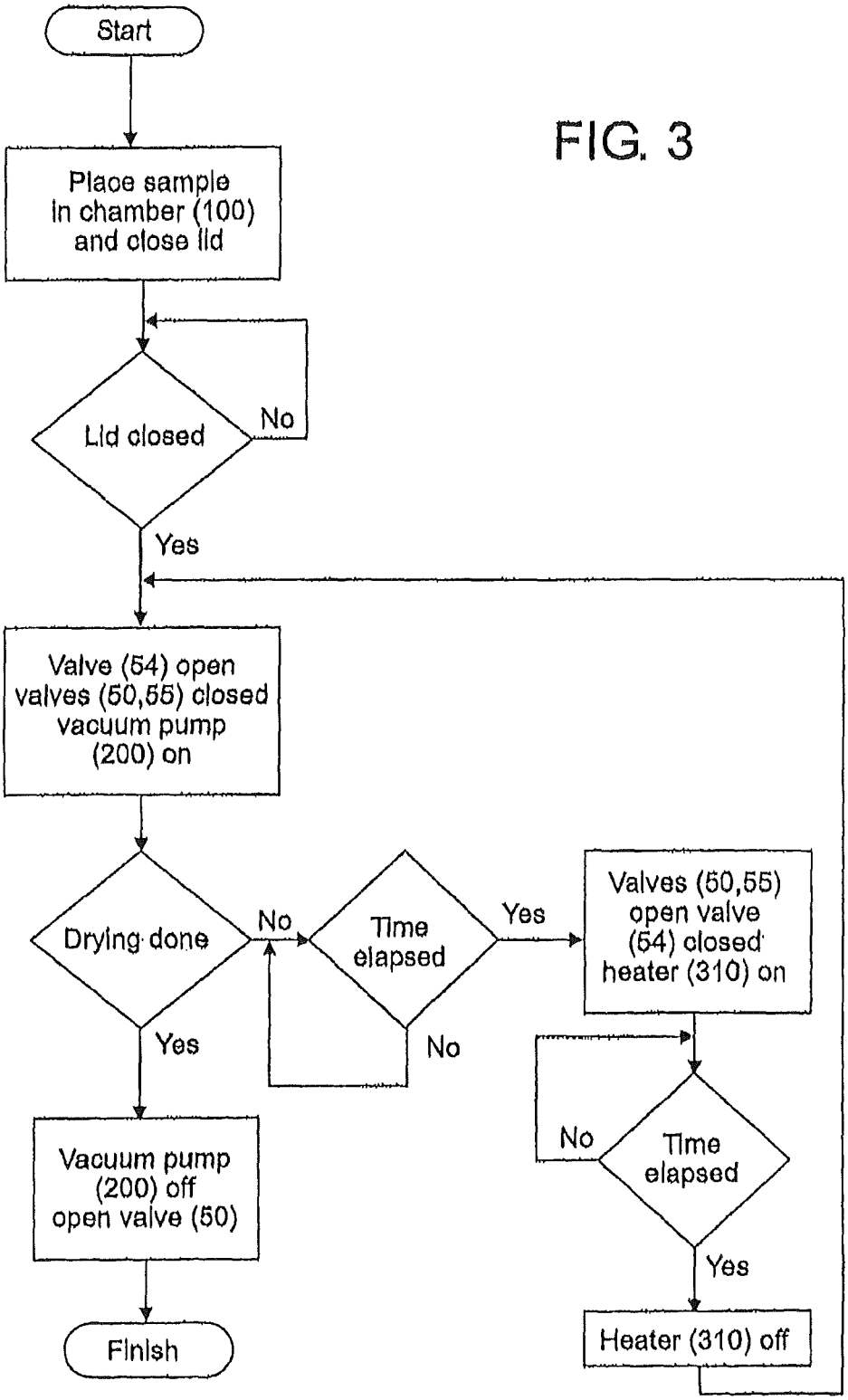
FIG. 3 shows a flow chart for operation of the rapid drying invention.

FIG. 3 is a flow chart for operation of the rapid drying invention (10) where the inlet line (110), the valve (50), and the heater (310) are operated to heat a controlled amount of air entering the sample chamber (100) during a portion of the drying cycle. In this embodiment, there is first a cycle where the valve (50) is closed, hence the sample chamber (100) is closed with no air entering the chamber (100). A vacuum pump (200) is turned on and air is pulled directly through the cold trap (300) by the vacuum pump (200) using the outlet line (120). The valve (55) is closed and the bypass (125) is not operating to allow air to directly enter the vacuum pump (200) from the sample chamber (100). The vacuum pump (200) will ordinarily be operated for a predetermined period of time. Once this time is elapsed, if the sample has not reached a predetermined level of dryness according to criteria incorporated by the controller (500) into the process, the heated air cycle will begin. At this point, the vacuum pump (200) may stop operating for a short period of time. Valves (50 and 55) will be opened, while valve (54) will be closed. The vacuum pump (200) may again start to operate or may have operated continuously. Air will enter the sample chamber (100) through the inlet (110) in an amount determined by the valve (50). This air will be heated by the heater (310). Heated air will be pulled to the vacuum pump (200) through the bypass line (125). The temperature may be monitored using temperature sensors (101, 311, 301) so as to not overheat the sample chamber (100) and the sample within the chamber (100) avoiding damaging either the sample or the components of the rapid drying invention (10). After a predetermined time, the valves (50 and 55) will be closed, the heater (310) will be turned off, and the initial process with the valve (54) opened will begin again. With valve (54) open and valves (50, 55) closed, the air exiting the sample chamber (100) will pass through the cold trap (300) before entering the vacuum pump (200). When it is determined the sample has sufficiently dried, the vacuum pump (200) will be turned off, the valve (50) will be opened, and the sample removed from the sample chamber (100) for appropriate testing or other processes. A number of parameters can be tested to determine if the drying process of a sample within the sample chamber (100) is complete. One parameter could be to determine what level of vacuum was present in the sample chamber (100) using vacuum gauge (800). If a predetermined high level of vacuum is created in the sample chamber (100), this would indicate that there was no more evaporated moisture being drawn from the sample chamber (100) by the vacuum pump (200). There could be a continuous weight measured using a load cell (600) placed in the sample chamber (100) or the sample could be removed from the chamber (100) and weighed repeatedly. As water is evaporated from the sample, the sample will lose weight proportionately to the loss of water from the sample. Thus, if over a period of time, the sample remains at a constant weight (+ or – a preset amount) through several cycles of the operation of the vacuum pump (200), then this relatively constant weight would be an indication that the sample is fully dried. A humidity sensor (350) could also be used to monitor the moisture to determine if the drying process was complete. Whatever parameter is used when the preset parameter is achieved, then the rapid drying invention (10) is stopped and the sample removed from the chamber (100). Typically, there is some kind of controller (500) to control the rapid drying invention (10). The controller (500) controls what cycle will come next in the process, will open and close the appropriate valves depending on what cycle is chosen, will operate the vacuum pump (200), and will use whatever sensors may be necessary to determine if the drying of the sample is complete. It is believed, in a commercial application, a programmable CPU computer with appropriate instrumentation and wiring will be used as a controller (500) to control the rapid drying invention (10).

Figure 4:
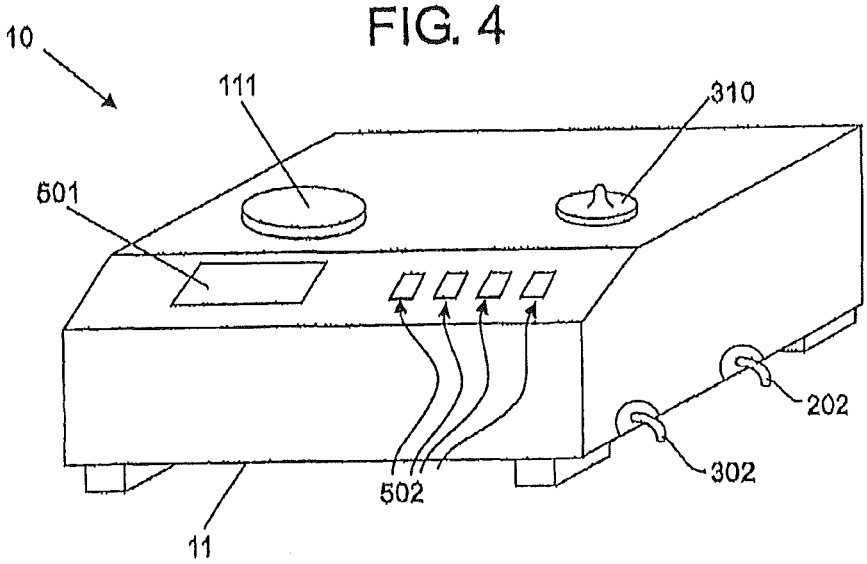
FIG. 4 shows a cabinet of a potential commercial embodiment of the rapid drying invention.

FIG. 4 shows a proposed commercial embodiment of a rapid drying invention (10). A cabinet (11) contains the functional parts of the rapid drying invention (10). On top of the cabinet (11) is a sample chamber lid (111) which opens to expose the sample chamber (100) so that a sample may be placed inside the sample chamber (100) and which, when the chamber lid (111) is closed, will be airtight. Also shown is a cold trap lid (310) which can be opened to expose the interior of the cold trap (300) so that condensed moisture and other trapped materials may be removed from the cold trap (300). Moisture may also be removed from the cold trap (300) using the drain valve (302). On the front of the cabinet (11), is a controller display (501) and controller input buttons (502), which can be used by an operator to operate the rapid drying invention (10). Typically, the controller display (501) could show vacuum within the chamber, could display time parameters, could display weights of material in the chamber, and other data of interest to a potential user. There is an oil drain (202) for maintenance of the vacuum pump (200).

Figure 5:
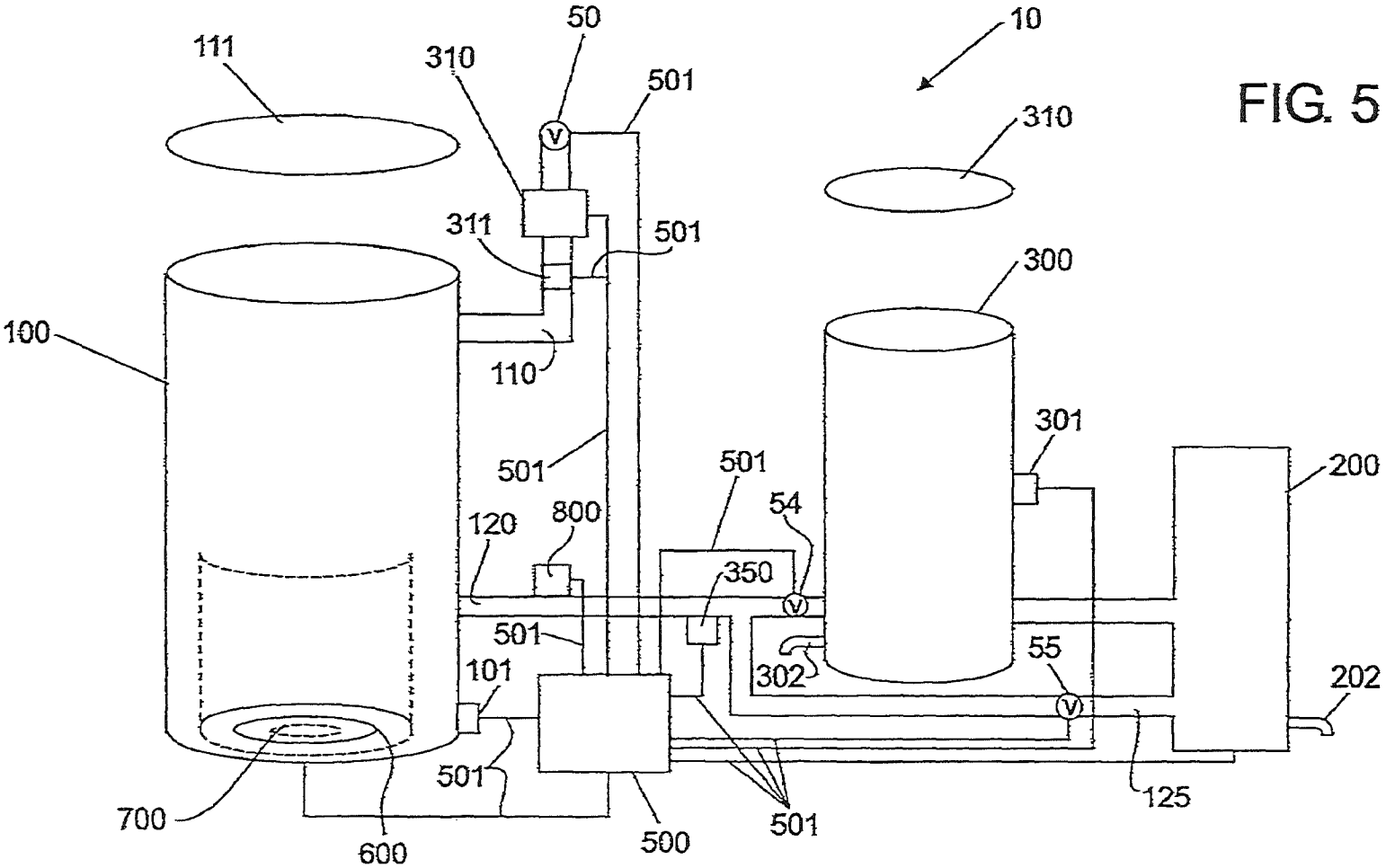
FIG. 5 shows the embodiment of FIG. 4 with the cabinet removed.

FIG. 5 shows the embodiment of FIG. 4 of the rapid drying invention (10) with the cabinet (11) removed, with some portions seen in partial cut-a-way for purposes of better visualizing parts of the rapid drying invention (10). The sample chamber (100) is shown in partial cut-a-way so that a load cell (600) usually positioned at the bottom of the sample chamber (100) may be seen. A load cell (600) can be used for continuous monitoring of the weight of a sample secured within the sample chamber (100) and return that data to the controller (500) by wires (501). The sample chamber lid (111) is shown above the sample chamber (100) where it may be raised or lowered as required to expose the interior of the sample chamber (100). The vacuum pump (200) is connected by outlet (120 and bypass lines (125) to the sample chamber (100) and to the cold trap (300). The vacuum pump (200) is connected by wires (501) to the controller (500) The controller (500) is also connected by wires (501) to a heater (310) and to appropriate valves (50,54, 55). In a heat cycle, as described in FIG. 3, the controller (500) would utilize the heater (310) the inlet line (110) and the vacuum pump (200) to allow a predetermined amount of heated air to enter the sample chamber (100) in response to a vacuum created in the sample chamber (100) by the vacuum pump (200), then be pulled to the bypass line (125) going directly to the vacuum pump (200). Outside air may be drawn into the heater (310) for entry into the chamber (100). During the cycle where no heated air is allowed to enter the sample chamber (100), the valve (50) will be closed and air will be drawn from the sample chamber (100) through the outlet (120) to the cold trap (300) and then to the vacuum pump (200) through the outlet (120). A heat pad (700) may be placed on the outside of the bottom of the sample chamber (100). The heat pad (700) keeps the bottom of the sample chamber (100) heated and evaporates water that might collect on the bottom of the sample chamber (100) from samples that may be placed inside the sample chamber (100). The controller (500) may use one or more of the sensors to respectively check the vacuum (vacuum gauge (800)), the humidity (humidity sensor (350)), or the weight (load cell (600)) to determine if the drying of the sample is complete. A vacuum pump (200) that has a capacity of 6.5 cubic feet per minute is available through Welch Vacuum, Inc. of Skokie, Ill. A heater (310) which may be used to heat incoming air through the inlet line (110) is a 400 watt heater available from Omega, Inc. of Stanford, Conn. The valves (50, 54, and 55) are commercially available through Asco Valves, Inc. of Florham Park, N.J. The cold trap (300) may use a thermoelectric cooler available through Melcor, Inc. of Trenton, N.J. The load cell (600) may use a single point load cell available through Vishay Teden Huntleigh of Covina, Calif. The heat pad (700) may use a heating pad with an adhesive back rated at 300 watts available through McMaster Company of Atlanta, Ga. A suitable vacuum gauge (800) is available through Newark Electronics™ of Palatine, Ill. and is made by Motorola™. Temperature sensors (101, 311, 301) are also available from Newark Electronics™. A humidity sensor (350) is available from McMaster Company™ of Atlanta, Ga. The controller (500) is constructed from available chip sets and central processing units and the construction of suitable controller from off-the-shelf parts is a matter of ordinary skill for this field. If an infrared lamp is used as a heater (310), a variety of commercially available lamps will serve.

That which is claimed is:

1. A system for drying an asphalt sample, comprising:
a cabinet;
a display held by the cabinet;
a sealable chamber in the cabinet, the chamber having an interior sized and configured to enclose an asphalt sample, the chamber comprising a vacuum port configured to be in fluid communication with a vacuum pump, the chamber further comprising an inlet port;
a first valve in the cabinet, the first valve in communication with the vacuum port of the chamber;
a second valve in communication with the inlet port of the chamber; and
a controller that:
opens and closes the first and second valves to cycle the chamber between a first state and a second state a plurality of times while drying the asphalt sample, wherein during the first state the first valve is open, the second valve is closed, and the vacuum pump is operated such that air is evacuated out of the chamber through the vacuum port, and wherein during the second state the first valve is open or closed, and the second valve is open and air is supplied through the inlet port to the interior of the chamber;
monitors vacuum pressure in the chamber; and
displays the monitored vacuum pressure on the display.

2. The system of claim 1, further comprising an external heater residing proximate the chamber to heat the air supplied through the inlet port of the chamber during the second state.

3. The system of claim 2, wherein the second valve and/or the external heater is in the cabinet.

4. The system of claim 1, further comprising a cold trap in fluid communication with the vacuum port of the chamber and held by the cabinet, wherein during operation, in the first state, evacuated air travels from the chamber, through the vacuum port, through the cold trap and then to the vacuum pump.

5. The system of claim 4, wherein the cold trap comprises a metal container and a thermoelectric cooler configured to chill the metal container.

6. The system of claim 5, wherein the cold trap is configured to direct air flow to contact surfaces of the metal container.

7. The system of claim 4, further comprising:
a cold trap evacuation flow path line, the cold trap evacuation flow path line connecting the vacuum port of the chamber to the cold trap and the vacuum pump;
a bypass evacuation flow path line to bypass the cold trap, the bypass evacuation flow path line connecting the vacuum port of the chamber and the vacuum pump; and
a third valve residing between the vacuum port of the chamber and the vacuum pump in the bypass evacuation flow path line;
wherein the first valve resides in the cold trap evacuation flow path line; and
wherein the controller opens and closes the third valve so that during the second state the third valve is open and the vacuum pump evacuates air from the chamber, through the vacuum port, and through the bypass evacuation flow path line.

8. The system of claim 1, further comprising a heating member residing below the chamber that is configured to heat the chamber.

9. The system of claim 1, further comprising an asphalt sample in the chamber.

10. The system of claim 1, further comprising a vacuum gauge in communication with the controller to measure a pressure in the interior of the chamber.

11. The system of claim 1, further comprising a load cell in the chamber to measure a weight of the sample, wherein the load cell is in communication with the controller, and wherein the controller monitors the weight of the sample.

12. The system of claim 1, further comprising at least one temperature sensor in communication with the chamber, wherein the controller monitors data from the at least one temperature sensor and maintains the temperature in the chamber at about room temperature.

13. The system of claim 1, wherein the sealable chamber is a cylindrical chamber, the system further comprising a lid configured to seal the chamber with the lid positioned to be releasable at an upper portion of the cabinet to provide user access to the chamber.

14. A system for drying an asphalt sample, comprising:
a cabinet;
a sealable chamber in the cabinet, the chamber having an interior sized and configured to enclose an asphalt sample, the chamber comprising a vacuum port configured to be in fluid communication with a vacuum pump, the chamber further comprising an inlet port;

a lid configured to seal the chamber with the lid positioned to be releasable at an upper portion of the cabinet to provide user access to the chamber;

a first valve in the cabinet, the first valve in communication with the vacuum port of the chamber;

a second valve in communication with the inlet port of the chamber;

a vacuum gauge in the cabinet, the vacuum gauge configured to measure vacuum pressure in the interior of the chamber; and a controller that:

opens and closes the first and second valves to cycle the chamber between a first mode and a second mode a plurality of times while drying the asphalt sample, wherein during the first mode the first valve is open, the second valve is closed, and the vacuum pump is operated such that air is evacuated out of the chamber through the vacuum port, and wherein during the second mode the first valve is open or closed, the second valve is open, and air is supplied through the inlet port to the interior of the chamber;

monitors vacuum pressure in the chamber while the chamber is cycled between the first mode and the second mode a plurality of times while drying the asphalt sample; and determines when the monitored vacuum pressure reaches a predetermined value to identify the asphalt sample as dry.

15. The system of claim 14, wherein the controller stops cycling the chamber between the first mode and the second mode when it is determined that the vacuum pressure reaches the predetermined value.

16. The system of claim 14, further comprising a cold trap in fluid communication with the vacuum port of the chamber and residing between the vacuum pump and the chamber, wherein during the first mode evacuated air travels from the interior of the chamber, through the vacuum port of the chamber, through the cold trap, then to the vacuum pump.

17. The system of claim 16, wherein the cold trap comprises a thermoelectric cooler.

18. The system of claim 14, wherein the sealable chamber is a cylindrical chamber.

19. A system for drying an asphalt sample, comprising:

a cabinet;

a display held by the cabinet;

a sealable chamber in the cabinet, the chamber having an interior sized and configured to enclose an asphalt sample, the chamber comprising first and second spaced-apart ports, wherein the second port is a vacuum port configured to be in fluid communication with a vacuum pump;

a lid configured to seal the chamber with the lid positioned at a top portion of the cabinet;

a first valve in communication with the first port of the chamber;

a second valve in communication with the second port of the chamber; and a controller that:

opens and closes the first and second valves to cycle the chamber between a first sealed state and a second unsealed state multiple times while drying the asphalt sample, wherein during the first sealed state the first valve is closed, the second valve is open, and the vacuum pump is operated such that air is evacuated out of the chamber through the second port, and wherein during the second unsealed state the second valve is open or closed, the first valve is open and air is supplied through the first port to the interior of the chamber;

monitors vacuum pressure in the chamber while the chamber is cycled between the first sealed state and the second unsealed state; and displays operational data on the display while the chamber is cycled between the first sealed state and a second unsealed state.

* * * * *